US009939118B2

(12) United States Patent
Beck

(10) Patent No.: US 9,939,118 B2
(45) Date of Patent: Apr. 10, 2018

(54) CONCEALER PLATE FOR A LIGHTING FIXTURE

(71) Applicant: Cree, Inc., Durham, NC (US)

(72) Inventor: Benjamin P. Beck, Union Grove, WI (US)

(73) Assignee: Cree, Inc., Durham, NC (US)

( * ) Notice: Subject to any disclaimer, the term of this patent is extended or adjusted under 35 U.S.C. 154(b) by 116 days.

(21) Appl. No.: 14/456,150

(22) Filed: Aug. 11, 2014

(65) Prior Publication Data

US 2016/0040863 A1 Feb. 11, 2016

(51) Int. Cl.

| | |
|---|---|
| ***F21V 15/00*** | (2015.01) |
| ***F21S 8/02*** | (2006.01) |
| *F21V 17/10* | (2006.01) |
| *F21V 17/16* | (2006.01) |
| *F21Y 105/10* | (2016.01) |
| *F21Y 115/10* | (2016.01) |
| *F21Y 113/13* | (2016.01) |

(52) U.S. Cl.

CPC ..... *F21S 8/026* (2013.01); *F21V 17/105* (2013.01); *F21V 17/101* (2013.01); *F21V 17/108* (2013.01); *F21V 17/164* (2013.01); *F21Y 2105/10* (2016.08); *F21Y 2113/13* (2016.08); *F21Y 2115/10* (2016.08)

(58) Field of Classification Search

CPC ..... F21S 8/02; F21S 8/026; F21V 17/105

USPC ..... 362/147–148, 150, 217.1–217.17, 362, 362/364–365, 368, 374–375, 398

See application file for complete search history.

(56) References Cited

U.S. PATENT DOCUMENTS

| | | | | |
|---|---|---|---|---|
| 7,168,825 | B2 * | 1/2007 | McArthur | F21S 8/022 362/153.1 |
| 2012/0131879 | A1 * | 5/2012 | Bergman | E04F 11/1812 52/704 |

FOREIGN PATENT DOCUMENTS

JP 06002374 A * 1/1994

* cited by examiner

*Primary Examiner* — Jason Moon Han

(74) *Attorney, Agent, or Firm* — Withrow & Terranova, P.L.L.C.

(57) ABSTRACT

A concealer plate for a lighting fixture includes a first concealer plate surface, a second concealer plate surface, and two or more magnets. The magnets are recessed in the first concealer plate surface such that the magnets are inset from the first concealer plate surface by approximately a predetermined depth. Each one of the magnets is configured to magnetically engage one of a number of fasteners protruding from a mounting portion of a trim of the lighting fixture by a distance that is approximately equal to the predetermined depth. Accordingly, the second concealer plate surface hides the fasteners from view. The concealer plate hides one or more fasteners exposed on the lighting fixture while avoiding any interference in the operation of the lighting fixture and is easily installed onto currently existing lighting fixtures.

17 Claims, 20 Drawing Sheets

CONCEALER PLATE FOR A LIGHTING FIXTURE

FIELD OF THE DISCLOSURE

The present disclosure relates to lighting fixtures. Specifically, the present disclosure relates to a concealer plate designed to enhance the aesthetic appeal of a lighting fixture.

BACKGROUND

In recent years, a movement has gained traction to replace incandescent light bulbs with lighting fixtures that employ more efficient lighting technologies. One such technology that shows tremendous promise employs light emitting diodes (LEDs). Compared with incandescent bulbs, LED-based light fixtures are much more efficient at converting electrical energy into light and are longer lasting, and as a result, lighting fixtures that employ LED technologies are expected to replace incandescent bulbs in residential, commercial, and industrial applications.

Like their incandescent counterparts, LED-based light fixtures come in a variety of designs. Generally, an LED-based lighting fixture will include a light source and a trim. The light source includes one or more LEDs and control electronics for driving the LEDs. In some designs, the light source may be affixed to the trim via one or more fasteners, such that the control electronics in the light source are thermally coupled to the trim. The fasteners used to affix the trim to the light source may remain exposed within the trim and visible even after the LED-based lighting fixture has been installed, thereby reducing the aesthetic appeal of the LED-based lighting fixture. As such, there is a need for a solution to conceal the fasteners within a trim of an LED-based lighting fixture in order to increase the aesthetic appeal of the LED-based lighting fixture that does not interfere with the operation of the LED-based lighting fixture and further is easily installed onto current LED-based lighting fixtures including exposed fasteners.

SUMMARY

The present disclosure relates to lighting fixtures, and specifically to a concealer plate designed to enhance the aesthetic appeal of a lighting fixture. In one embodiment, a concealer plate for a lighting fixture includes a concealer plate body and two or more magnets. The concealer plate body includes a first concealer plate surface, a second concealer plate surface opposite the first concealer plate surface, two or more of recesses each including a bottom surface and extending from the first concealer plate surface into the concealer plate body, and an opening extending through a central portion of the concealer plate body. The two or more magnets are each attached to the bottom surface of a respective one of the recesses, and are configured to magnetically engage one of a number of fasteners used to attach a mounting portion of a trim to the lighting fixture such that the concealer plate hides the fasteners from view. Accordingly, the concealer plate hides one or more fasteners exposed on the lighting fixture while avoiding any interference in the operation of the lighting fixture and is easily installed onto currently existing lighting fixtures.

In one embodiment, a distance from a first magnetic surface of each one of the magnets, which is opposite the bottom surface of the recess to which the magnet is attached, to the first concealer plate surface is approximately equal to a distance that each one of the fasteners protrude from the mounting portion of the trim of the lighting fixture.

In one embodiment, a lighting fixture includes a light source, a trim, and a concealer plate. The trim includes a sidewall extending between a mounting portion and a forward edge, wherein the light source is mounted to a first mounting surface of the mounting portion opposite the forward edge via a number of fasteners, such that light emitted from the light source is directed through the opening in the mounting portion and towards the forward edge. The concealer plate includes a concealer plate body and two or more magnets. The concealer plate body includes a first concealer plate surface, a second concealer plate surface opposite the first concealer plate surface, two or more of recesses each including a bottom surface and extending from the first concealer plate surface into the concealer plate body, and an opening extending through a central portion of the concealer plate body. The two or more magnets are each attached to the bottom surface of a respective one of the recesses, and are configured to magnetically engage one of the fasteners used to attach the mounting portion of the trim to the lighting fixture such that the concealer plate hides the fasteners from view. Accordingly, the concealer plate hides one or more fasteners exposed on the lighting fixture while avoiding any interference in the operation of the lighting fixture and is easily installed onto currently existing lighting fixtures.

In one embodiment, a distance from a first magnetic surface of each one of the magnets, which is opposite the bottom surface of the recess to which the magnet is attached, to the first concealer plate surface is approximately equal to a distance that each one of the fasteners protrude from the mounting portion of the trim of the lighting fixture.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
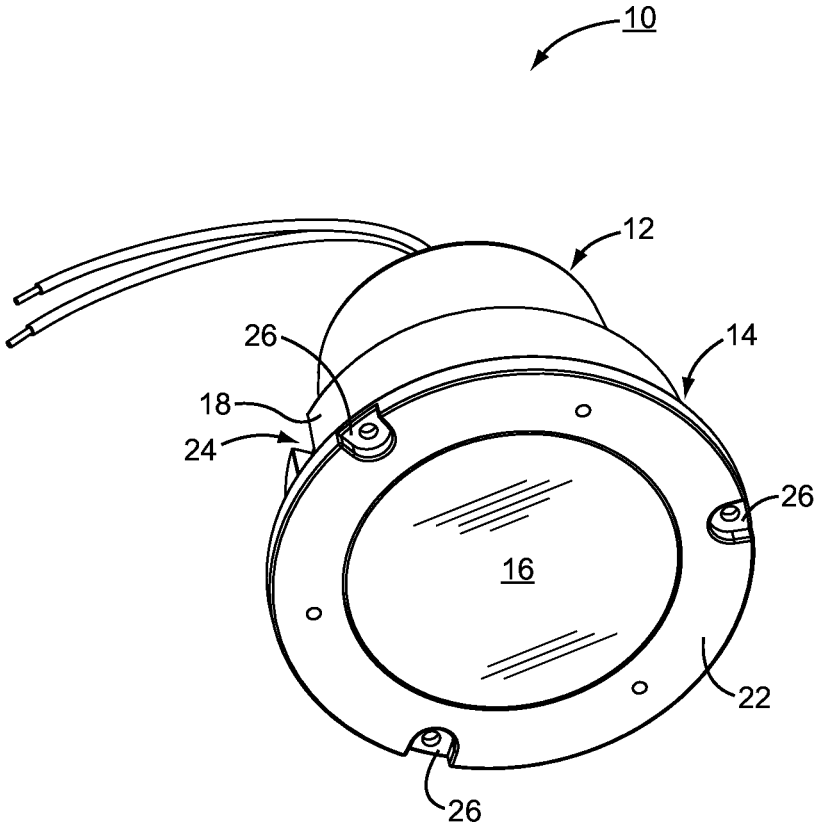
FIG. 1 is an isometric view of the front of the lighting fixture according to one embodiment of the disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 2:
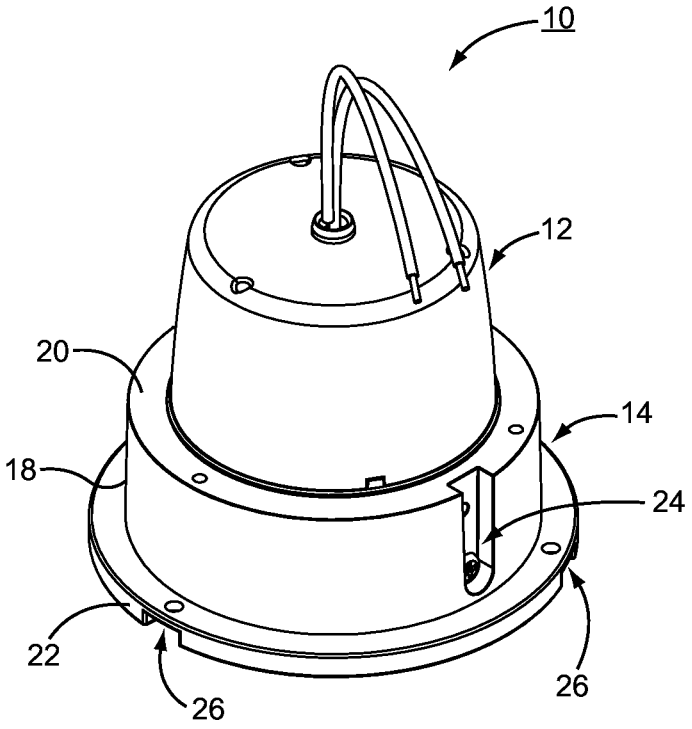
FIG. 2 is an isometric view of the back of the lighting fixture of FIG. 1.
Figure 3:
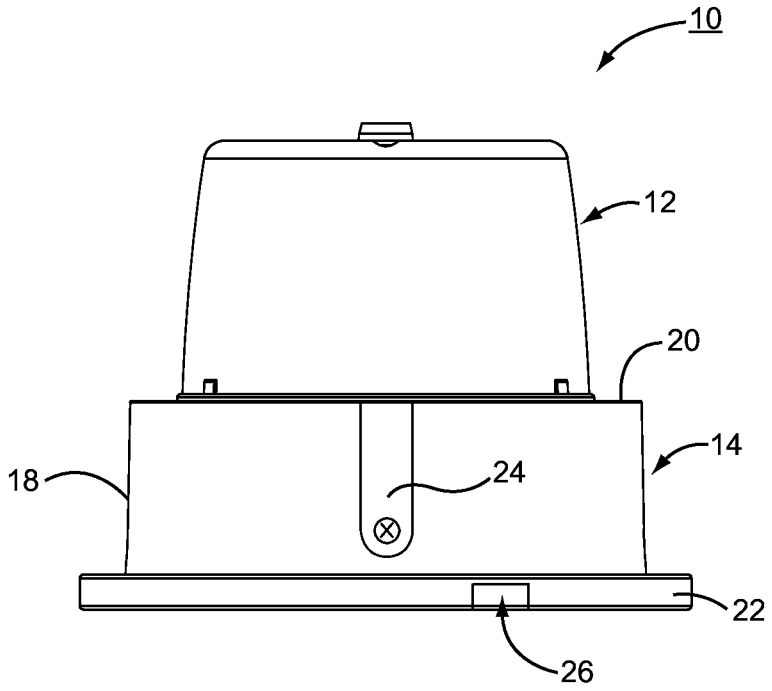
FIG. 3 is a side plan view of the lighting fixture of FIG. 1.

With reference to FIGS. 1-3, a lighting fixture 10 is illustrated according to one embodiment of the present disclosure. As shown, the lighting fixture 10 includes a control module 12, a heat spreading cup 14, and a lens assembly 16. A light source (not shown), which will be described in detail further below, is mounted inside the heat spreading cup 14 and oriented such that light is emitted from the heat spreading cup through the lens assembly 16. The electronics (not shown) that are required to power and drive the light source are provided, at least in part, by the control module 12. While the lighting fixture 10 is envisioned to be used predominantly in 4, 5, and 6 inch recessed lighting applications for industrial, commercial, and residential applications, the concepts disclosed herein are applicable to virtually any size and application.

The lens assembly 16 may include one or more lenses that are made of clear or transparent materials, such as polycarbonate or acrylic. The lens assembly 16 may include a diffuser for diffusing the light emanated from the light source and exiting the heat spreading cup 14 via the lens assembly 16. Further, the lens assembly 16 may also be configured to shape or direct the light exiting the heat spreading cup 14 via the lens assembly 16 in a desired manner.

The control module 12 and the heat spreading cup 14 may be integrated and provided by a single structure. Alternatively, the control module 12 and the heat spreading cup 14 may be modular wherein different sizes, shapes, and types of control modules 12 may be attached, or otherwise connected, to the heat spreading cup 14 and used to drive the light source provided therein.

The heat spreading cup 14 is made of a material that provides good thermal conductivity, such as metal, ceramic, or the like. In the disclosed embodiment, the heat spreading cup 14 is formed from aluminum, but other metals, or thermally conductive materials, are applicable. Lighting fixtures, such as the illustrated lighting fixture 10, are particularly beneficial for recessed lighting applications wherein most, if not all of the lighting fixture 10 is recessed into a cavity within a wall, ceiling, cabinet, or like structure. Heat generated by the light source or electronics of the control module 12 is often trapped within the cavity. After prolonged operation, even an efficient lighting fixture 10 can cause sufficient heat to be trapped in the cavity, which may cause damage to the lighting fixture 10 itself or its surroundings.

Historically, fixture designers have placed heat sinks near the rear of lighting fixtures in an effort to transfer heat away from the light source or control electronics. Unfortunately, transferring heat toward the rear of the lighting fixtures effectively transfers the heat directly into the cavity in which the lighting fixture is mounted. As a result, the cavity heats up to a point where the heat sink no longer functions to transfer heat from the control electronics or light source, and damage to the lighting fixture ensues.

Instead of directing heat transfer toward the rear of the lighting fixture 10 and into the cavity in which the lighting fixture 10 is mounted, the lighting fixture 10 of the present disclosure employs the heat spreading cup 14 to direct heat transfer toward the front of the lighting fixture 10. Even when mounted into a cavity, the front of the lighting fixture 10 is either exposed to the ambient environment, or in select embodiments, coupled to a trim that is also exposed to the ambient environment. By directing heat transfer toward the front of the lighting fixture 10, the amount of heat that would otherwise be directed into the cavity in which the lighting fixture 10 is mounted is significantly reduced. By reducing the amount of heat directed toward the rear of the lighting fixture 10, the performance and longevity of the lighting fixture 10 may be enhanced, the number of acceptable mounting conditions and applications may be increased, the cost of the lighting fixture 10 may be reduced by being able to use less expensive components, or any combination thereof.

In the illustrated embodiment, the heat spreading cup 14 is cup-shaped and includes a sidewall 18 that extends between a bottom panel 20 at the rear of the heat spreading cup 14, and a rim, which may be provided by an annular flange 22 at the front of the heat spreading cup 14. One or more elongated slots 24 may be formed in the outside surface of the sidewall 18. As illustrated, there are two elongated slots 24, which extend parallel to a central axis of the lighting fixture 10 from the rear surface of the bottom panel 20 toward, but not completely to, the annular flange 22. The elongated slots 24 may be used for a variety of purposes, such as providing a channel for a grounding wire that is connected to the heat spreading cup 14 inside the elongated slot 24, connecting additional elements to the lighting fixture 10, or as described further below, securely attaching the lens assembly 16 to the heat spreading cup 14.

The annular flange 22 may include one or more mounting recesses 26 in which mounting holes are provided. The mounting holes may be used for mounting the lighting fixture 10 to a mounting structure or for mounting accessories to the lighting fixture 10. The mounting recesses 26 provide for counter-sinking the heads of bolts, screws, or other attachment means below or into the front surface of the annular flange 22.

Figure 4:
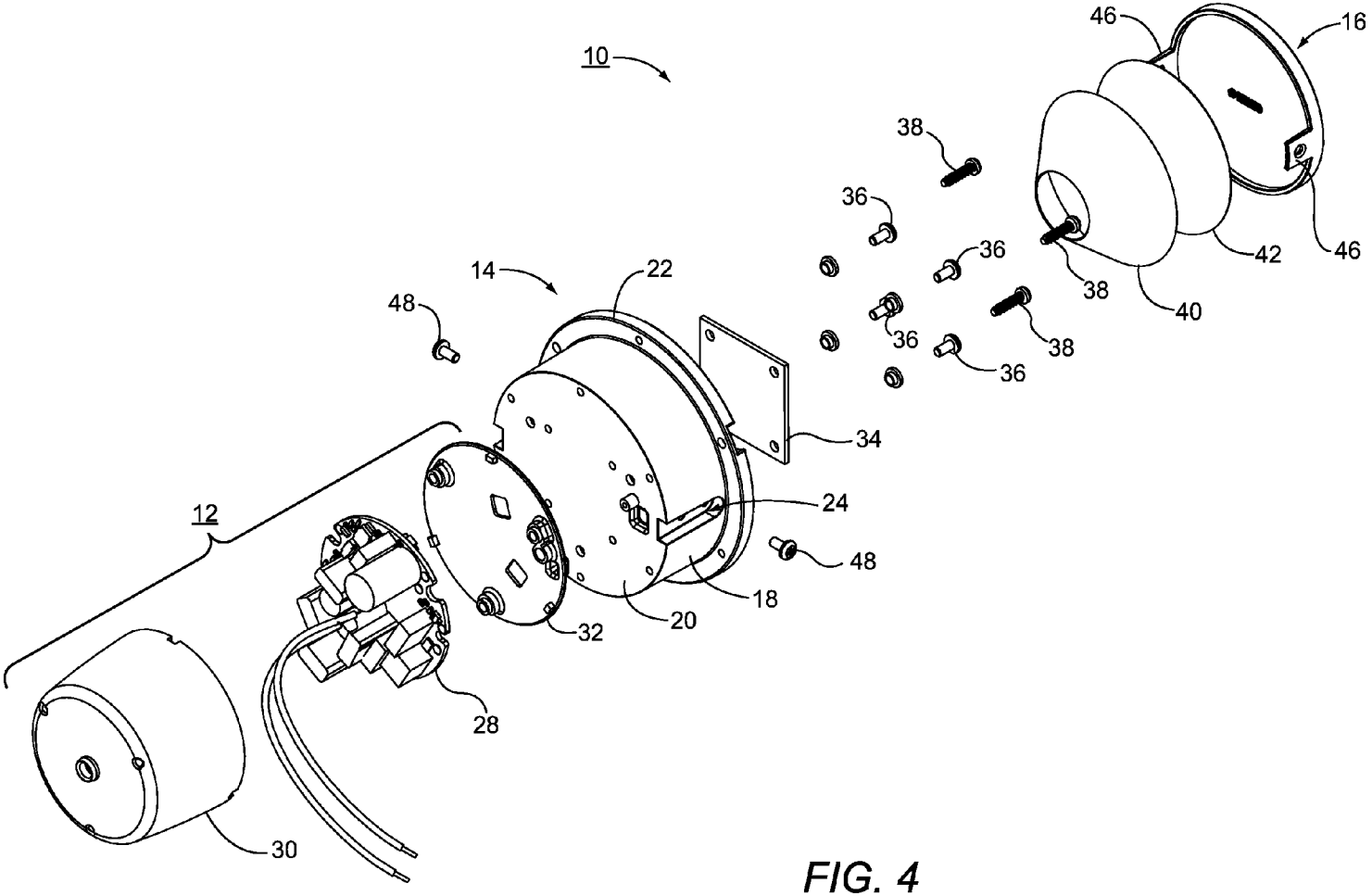
FIG. 4 is an exploded isometric view of the lighting fixture of FIG. 1.

With reference to FIG. 4, an exploded view of the lighting fixture 10 of FIGS. 1-3 is provided. As illustrated, the control module 12 includes control module electronics 28, which are encapsulated by a control module housing 30 and a control module cover 32. The control module housing 30 is cup-shaped and sized sufficiently to receive the control module electronics 28. The control module cover 32 provides a cover that extends substantially over the opening of the control module housing 30. Once the control module cover 32 is in place, the control module electronics 28 are contained within the control module housing 30 and the control module cover 32. The control module 12 is, in the illustrated embodiment, mounted to the rear surface of the bottom panel 20 of the heat spreading cup 14.

The control module electronics 28 may be used to provide all or a portion of power and control signals necessary to power and control a light source 34, which may be mounted on the front surface of the bottom panel 20 of the heat spreading cup 14. Aligned holes or openings in the bottom panel 20 of the heat spreading cup 14 and the control module cover 32 are provided to facilitate an electrical connection between the control module electronics 28 and the light source 34. In the illustrated embodiment, the light source 34 is solid state and employs one or more light emitting diodes (LEDs) and associated electronics, which are mounted to a printed circuit board (PCB) to generate light at a desired magnitude and color temperature. The LEDs are mounted on the front side of the PCB while the rear side of the PCB is mounted to the front surface of the bottom panel 20 of the heat spreading cup 14 directly or via a thermally conductive pad (not shown). The thermally conductive pad has a low thermal resistivity, and therefore, efficiently transfers heat that is generated by the light source 34 to the bottom panel 20 of the heat spreading cup 14. While an LED-based light source is the focus herein, other lighting technologies, such as but not limited to high-intensity discharge (HID) bulbs, readily benefit from the disclosed concepts.

While various mounting mechanisms are available, the illustrated embodiment employs four bolts 36 to attach the PCB of the light source 34 to the front surface of the bottom panel 20 of the heat spreading cup 14. The bolts 36 screw into threaded holes provided in the front surface of the bottom panel 20 of the heat spreading cup 14. Three bolts 38 are used to attach the heat spreading cup 14 to the control module 12. In this particular configuration, the bolts 38 extend through corresponding holes provided in the heat spreading cup 14 and the control module cover 32 and screw into threaded apertures (not shown) provided just inside the rim of the control module housing 30. As such, the bolts 38 effectively sandwich the control module cover 32 between the heat spreading cup 14 and the control module housing 30.

A reflector cone 40 resides within the interior chamber provided by the heat spreading cup 14. In the illustrated embodiment, the reflector cone 40 has a conical wall that extends between a larger front opening and a smaller rear opening. The larger front opening resides at and substantially corresponds to the dimensions of the front opening in the heat spreading cup 14 that corresponds to the front of the interior chamber provided by the heat spreading cup 14. The smaller rear opening of the reflector cone 40 resides about and substantially corresponds to the size of the LED or array of LEDs provided by the light source 34. The front surface of the reflector cone 40 is generally, but not necessarily, highly reflective in an effort to increase the overall efficiency of the lighting fixture 10. In one embodiment, the reflector cone 40 is formed from metal, paper, a polymer, or a combination thereof. In essence, the reflector cone 40 provides a mixing chamber for light emitted from the light source 34, and as described further below, may be used to help direct or control how the light exits the mixing chamber through the lens assembly 16.

Figure 5:
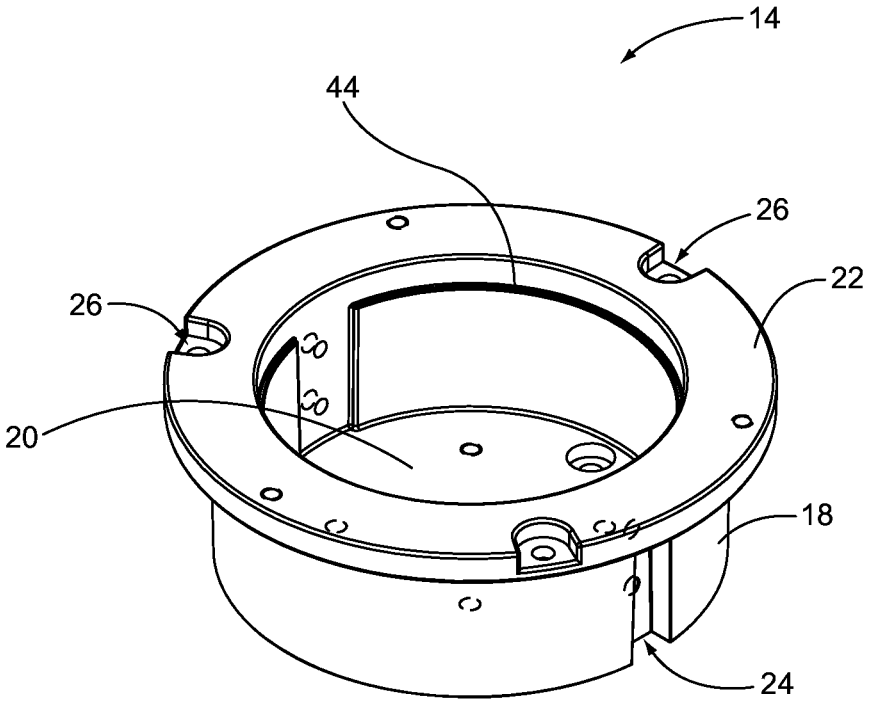
FIG. 5 is an isometric view of the front of the heat spreading cup of the lighting fixture of FIG. 1.
Figure 6:
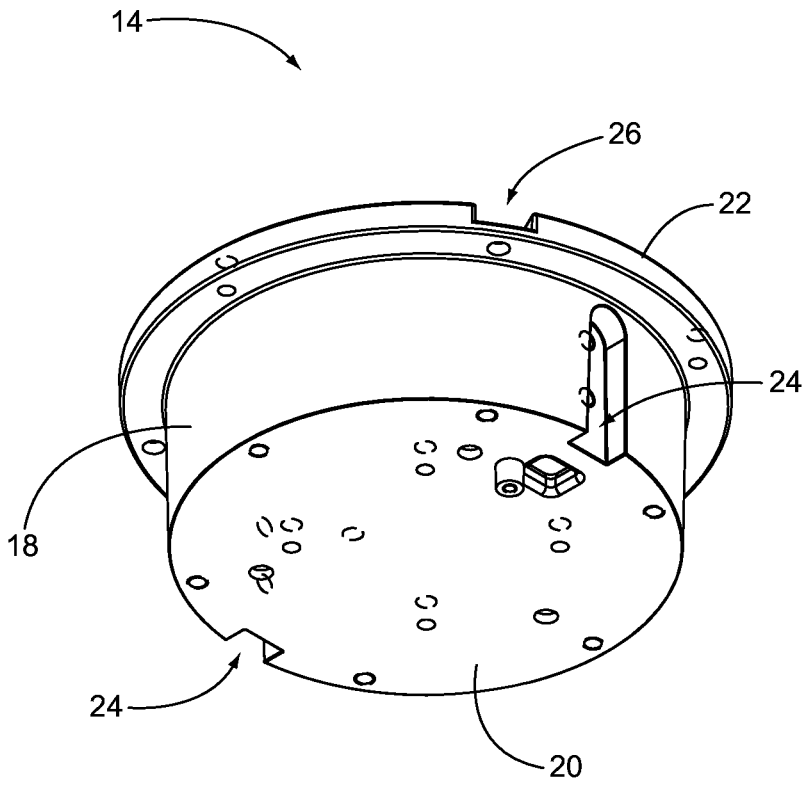
FIG. 6 is an isometric view of the rear of the heat spreading cup of the lighting fixture of FIG. 1.

When assembled, the lens assembly 16 is mounted on or to the annular flange 22 and may be used to hold the reflector cone 40 in place within the interior chamber of the heat spreading cup 14 as well as hold additional lenses and one or more diffusers 42 in place. In the illustrated embodiment, the lens assembly 16 and the diffuser 42 generally correspond in shape and size to the front opening of the heat spreading cup 14 and are mounted such that the front surface of the lens is substantially flush with the front surface of the annular flange 22. As shown in FIGS. 5 and 6, a recess 44 is provided on the interior surface of the sidewall 18 and substantially around the opening of the heat spreading cup 14. The recess 44 provides a ledge on which the diffuser 42 and the lens assembly 16 rest inside the heat spreading cup 14. The recess 44 may be sufficiently deep such that the front surface of the lens assembly 16 is flush with the front surface of the annular flange 22.

Returning to FIG. 4, the lens assembly 16 may include tabs 46, which extend rearward from the outer periphery of the lens assembly 16. The tabs 46 may slide into corresponding channels on the interior surface of the sidewall 18 (see FIGS. 5 and 7). The channels are aligned with corresponding elongated slots 24 on the exterior of the sidewall 18. The tabs 46 have threaded holes that align with holes provided in the grooves and elongated slots 24. When the lens assembly 16 resides in the recess 44 at the front opening of the heat spreading cup 14, the holes in the tabs 46 will align with the holes in the elongated slots 24. Bolts 48 may be inserted through the holes in the elongated slots and screwed into the holes provided in the tabs 46 to affix the lens assembly 16 to the heat spreading cup 14. When the lens assembly 16 is secured, the diffuser 42 is sandwiched between the lens assembly and the recess 44, and the reflector cone 40 is contained between the diffuser 42 and the light source 34.

The degree and type of diffusion provided by the diffuser 42 may vary from one embodiment to another. Further, color, translucency, or opaqueness of the diffuser 42 may vary from one embodiment to another. The diffuser 42 is typically formed from a polymer or glass, but other materials are viable. Similarly, the lens assembly 16 includes a planar lens, which generally corresponds to the shape and size of the diffuser 42 as well as the front opening of the heat spreading cup 14. As with the diffuser 42, the material, color, translucency, or opaqueness of the lens or lenses provided by the lens assembly 16 may vary from one embodiment to another. Further, both the diffuser 42 and the lens assembly 16 may be formed from one or more materials or one or more layers of the same or different materials. While only one diffuser 42 and one lens (in lens assembly 16) are depicted, the lighting fixture 10 may have multiple diffusers 42 or lenses; no diffuser 42; no lens; or an integrated diffuser and lens (not shown) in place of the illustrated diffuser 42 and lens.

Figure 7:
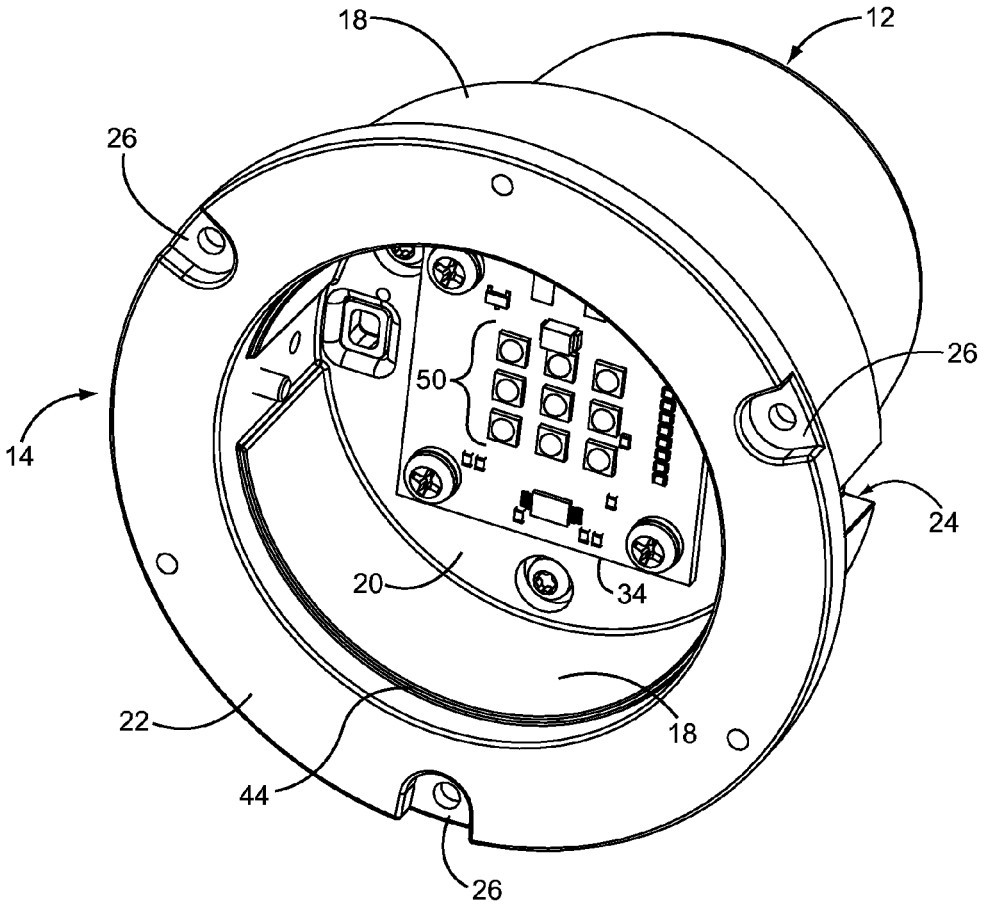
FIG. 7 is an isometric view of the front of the lighting fixture of FIG. 1 without the lens assembly, diffuser, and reflector.

For LED-based applications, the light source 34 provides an array of LEDs 50, as illustrated in FIG. 7. FIG. 7 illustrates a front isometric view of the lighting fixture 10, with the lens assembly 16, the diffuser 42, and the reflector cone 40 removed. Light emitted from the array of LEDs 50 is mixed inside the mixing chamber formed by the reflector cone 40 (not shown) and directed out through the lens assembly 16 in a forward direction to form a light beam. The array of LEDs 50 of the light source 34 may include LEDs 50 that emit different colors of light. For example, the array of LEDs 50 may include both red LEDs 50 that emit red light and blue-shifted green LEDs 50 that emit bluish-green light, wherein the red and bluish-green light is mixed to form "white" light at a desired color temperature. For a uniformly colored light beam, relatively thorough mixing of the light emitted from the array of LEDs 50 is desired. Both the mixing chamber provided by the reflector cone 40 and the diffuser 42 play a role in mixing the light emanated from the array of LEDs 50 of the light source 34.

Certain light rays, which are referred to as non-reflected light rays, emanate from the array of LEDs 50 and exit the mixing chamber through the diffuser 42 and lens assembly 16 without being reflected off of the interior surface of the reflector cone 40. Other light rays, which are referred to as reflected light rays, emanate from the array of LEDs of the light source 34 and are reflected off of the front surface of the reflector cone 40 one or more times before exiting the mixing chamber through the diffuser 42 and lens assembly 16. With these reflections, the reflected light rays are effectively mixed with each other and at least some of the non-reflected light rays within the mixing chamber before exiting the mixing chamber through the diffuser 42 and the lens assembly 16.

As noted above, the diffuser 42 functions to diffuse, and as result, mix the non-reflected and reflected light rays as they exit the mixing chamber, wherein the mixing chamber and the diffuser 42 provide sufficient mixing of the light emanated from the array of LEDs 50 of the light source 34 to provide a light beam of a consistent color. In addition to mixing light rays, the diffuser 42 may be designed and the reflector cone 40 shaped in a manner to control the relative concentration and shape of the resulting light beam that is projected from the lighting fixture 10. For example, a first lighting fixture 10 may be designed to provide a concentrated beam for a spotlight, wherein another may be designed to provide a widely dispersed beam for a floodlight.

Figure 8:
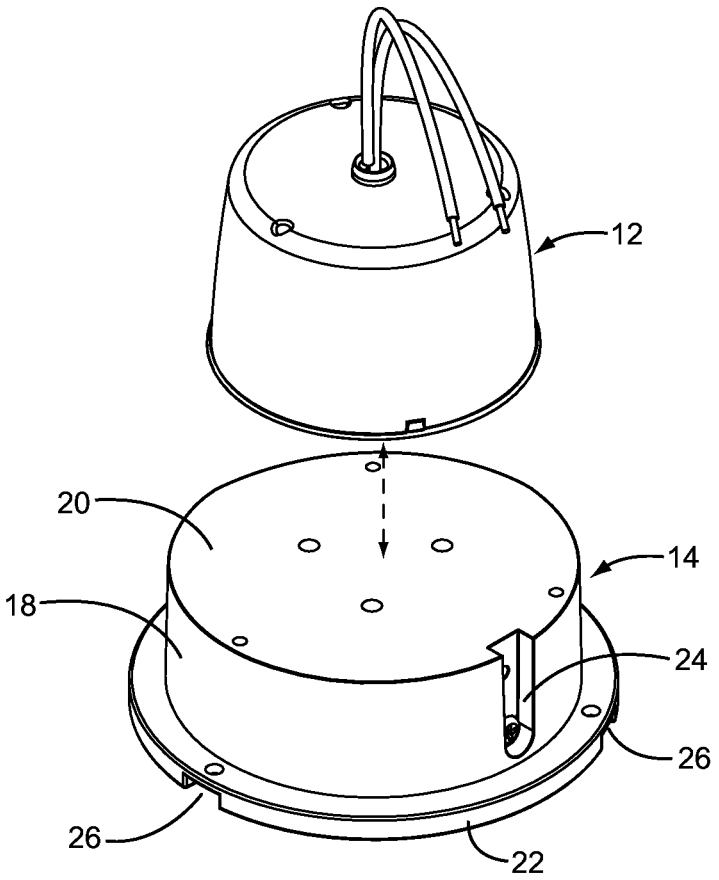
FIG. 8 illustrates the separation of the control module and heat spreading cup of the lighting fixture.

In select embodiments, the lighting fixture 10 is designed to work with different types of control modules 12. For example, the lighting fixture 10 may be designed to work with a control module 12 that is located remotely. As illustrated in FIG. 8, plugs or apertures are provided in the heat spreading cup 14 to facilitate the necessary electrical connection to a variety of control modules 12. As such, different manufactures are empowered to design and manufacture control modules 12 for another manufacturer's heat spreading cup 14 and light source 34 assembly, and vice versa. Further, different shapes and sizes of control modules 12 may be manufactured for a given heat spreading cup 14 and light source 34 assembly, and vice versa.

Figure 9:
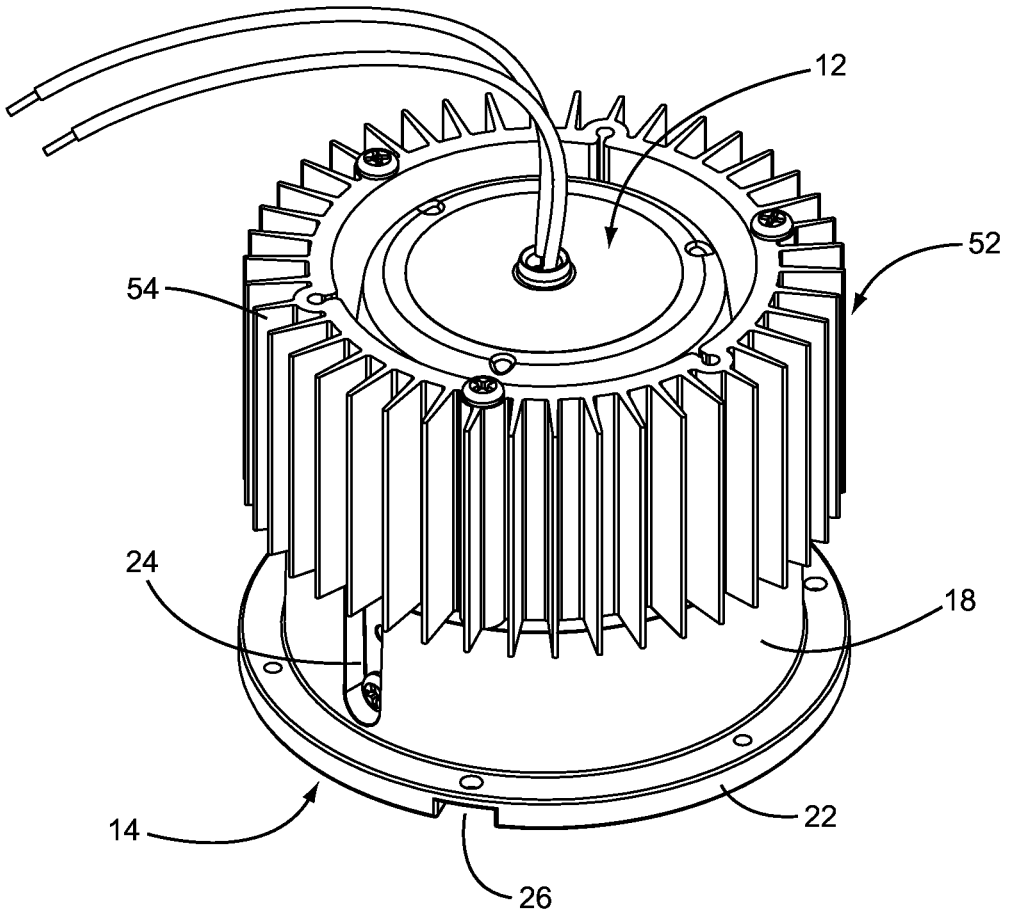
FIG. 9 is an isometric view of the rear of the lighting fixture of FIG. 1 with an optional heat sink.
Figure 10:
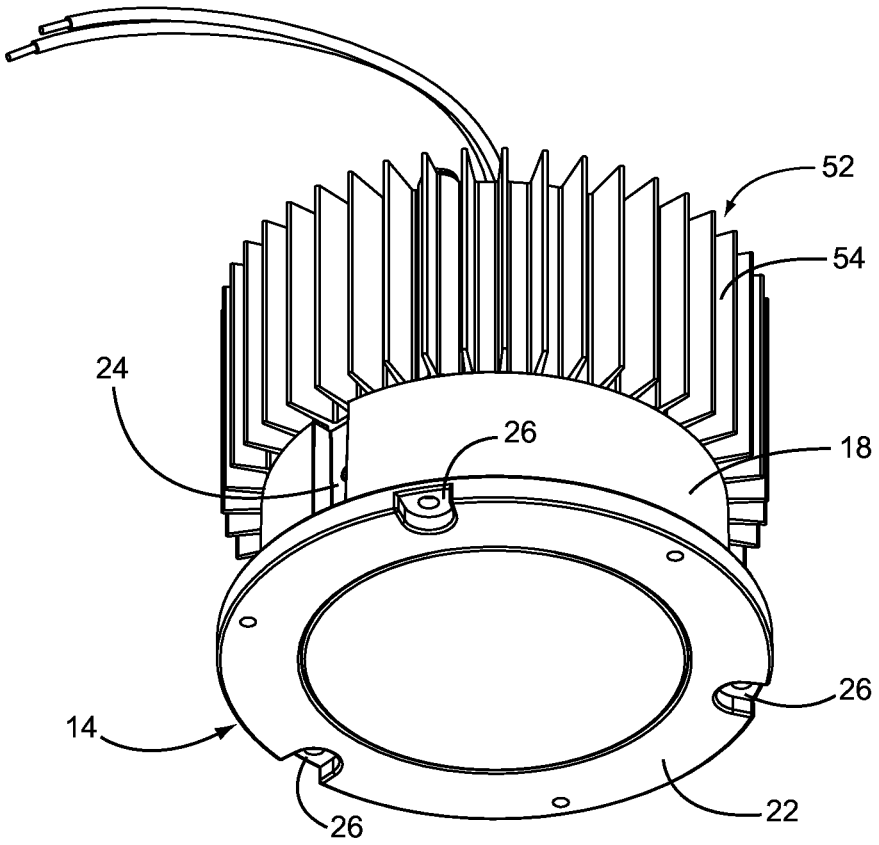
FIG. 10 is an isometric view of the front of the heat spreading cup of the lighting fixture of FIG. 1 with an optional heat sink.

With reference to FIGS. 9 and 10, an optional heat sink 52 may be provided for the lighting fixture 10. In the illustrated embodiment, the heat sink 52 is substantially cylindrical and provides an interior opening that is sized to receive the control module 12 and rest against an outer portion of the rear surface of the bottom panel 20 of the heat spreading cup 14. In other embodiments wherein a remotely located control module 12 is used with the lighting fixture 10, the heat sink 52 may be solid rather than cylindrical. The heat sink 52 includes radial fins 54 that are substantially parallel to the central axis of the lighting fixture 10. A thermally conductive pad or other material may be provided between the heat sink 52 and the heat spreading cup 14 to enhance the thermal coupling of the heat sink 52 and the heat spreading cup 14.

Without the heat sink 52, most of the heat generated by the control module electronics 28 and the light source 34 is transferred outward to the sidewall 18 via the bottom panel 20 of the heat spreading cup 14, and then forward along the sidewall 18 to the front of the lighting fixture 10. As such, a significant amount, if not a majority, of the heat is transferred to the front of the lighting fixture 10, instead of being transferred to the rear of the lighting fixture 10 where it may be trapped within the cavity in which the lighting fixture 10 is mounted. In embodiments where the heat sink 52 is provided, a certain amount of the heat that is transferred outward along the bottom panel 20 of the heat spreading cup 22 will be transferred rearward to the heat sink 52 while a certain amount of the heat is transferred forward along the sidewall 18.

Figure 11:
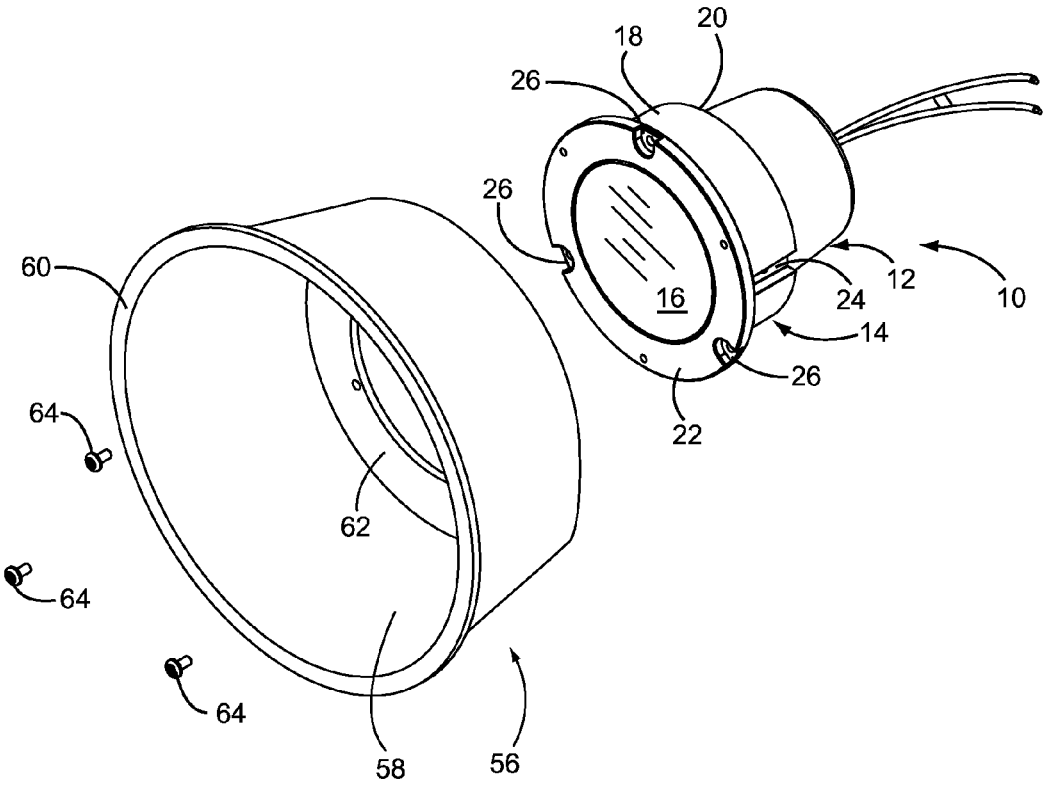
FIG. 11 is an exploded isometric view of the lighting fixture of FIG. 1 and a trim.
Figure 12:
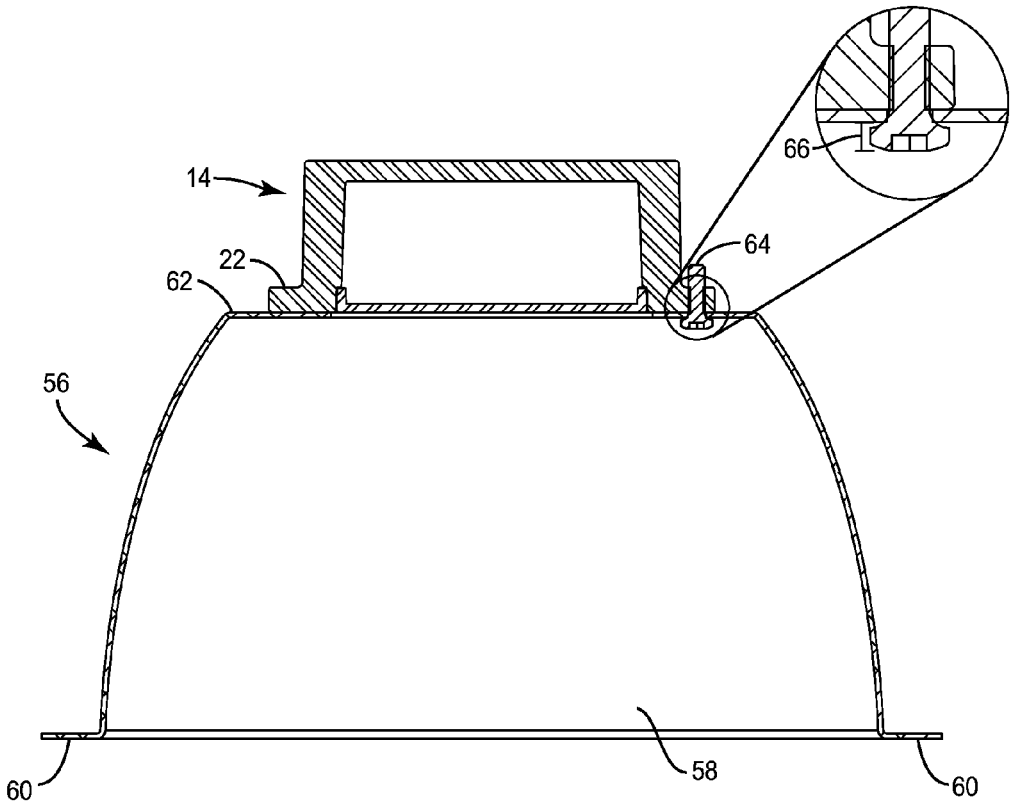
FIG. 12 is a side plan view of the assembly of FIG. 11.
Figure 13:
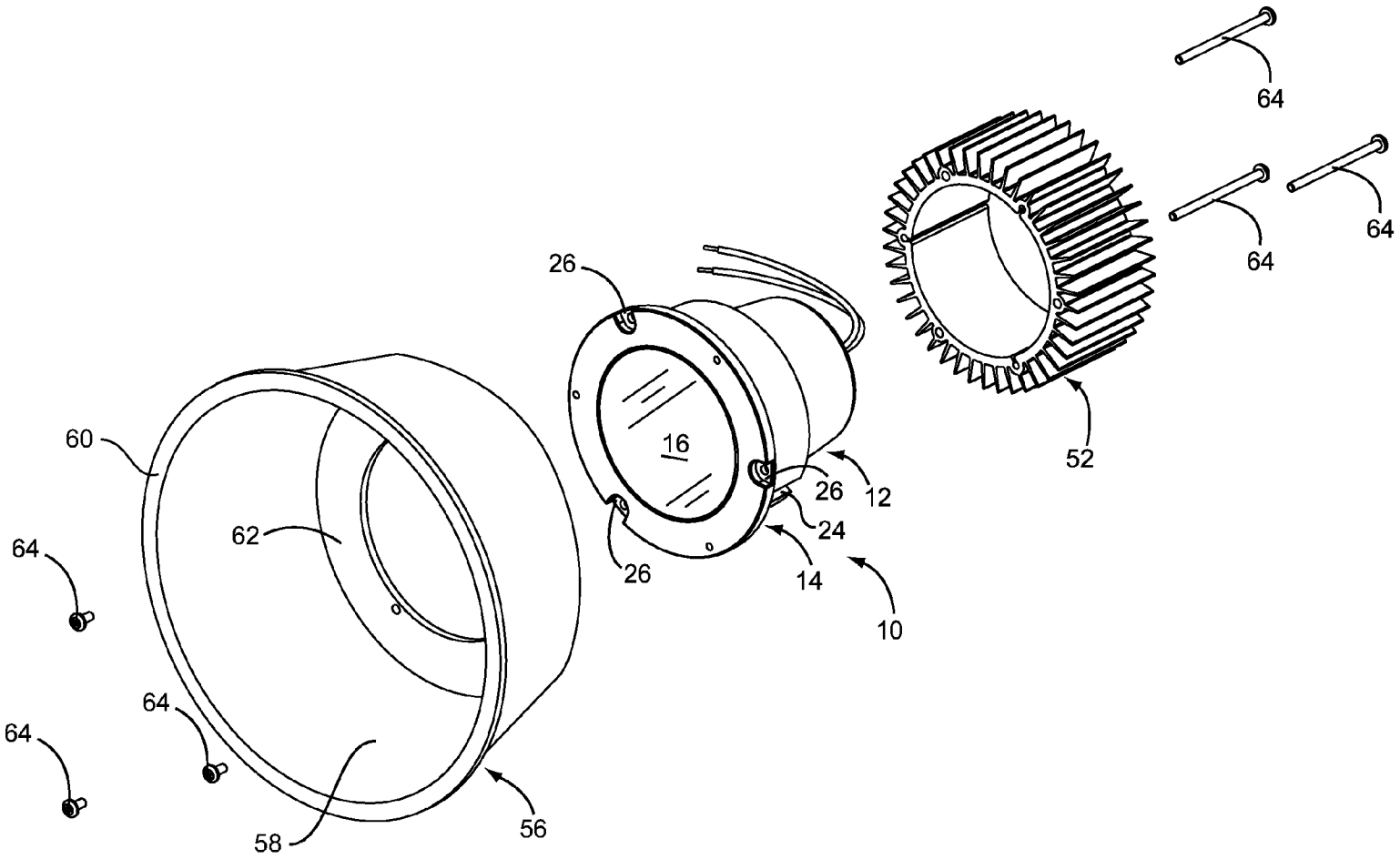
FIG. 13 is an exploded isometric view of the lighting fixture of FIG. 1, a trim, and a heat sink.

The lighting fixture 10 may be used in conjunction with any number of accessories. An exemplary accessory, such as a trim 56, is shown in FIGS. 11-13. In the illustrated embodiment, the trim 56 has a substantially cylindrical sidewall 58 extending between a forward edge 60 and a mounting portion 62. The mounting portion 62 may be annular, such that the mounting portion 62 has a circular opening that is roughly the size of the lens assembly 16 of the lighting fixture 10. As illustrated in FIGS. 12 and 13, the lighting fixture 10 is mounted onto the trim 56 such that the annular flange 22 of the heat spreading cup 14 contacts the mounting portion 62 of the trim 56. In particular, the front surface of the annular flange 22 of the heat spreading cup 14 rests against the rear surface of the mounting portion 62 of the trim 56. Fasteners 64 may be used to attach the heat spreading cup 14, and thus the entirety of the lighting fixture 10, to the mounting portion 62 of the trim 56. The fasteners 64 extend through holes provided in the mounting portion 62 of the trim 56, and may be attached to bolts or receiving fasteners located on the rear side of the annular flange 22 of the heat spreading cup 14. Notably, each one of the fasteners 64 may protrude from the front surface of the mounting portion 62 by a predetermined depth 66, such that each one of the fasteners 64 is exposed to the front of the trim 56.

As noted above, the heat spreading cup 14 functions to transfer heat that is generated from the light source 34 and the control module electronics 28 forward toward and to the annular flange 22. As a result, the heat is transferred toward the ambient environment and away from the cavity into which the rear of the lighting fixture 10 extends. If the trim 56 is of a material that conducts heat, the heat transfer from the light source 34 and the control module electronics 28 may be further transferred from the annular flange 22 of the heat spreading cup 14 to the mounting portion 62 of the trim 56. Once transferred to the mounting portion 62 of the trim 56, the heat is transferred outward to the sidewall 58 and then forward along the sidewall 58 toward the forward edge 60 of the trim 56. In essence, the trim 56 may operate as a heat spreading extension to the heat spreading cup 14 of the lighting fixture 10. To act as a heat spreading extension, the trim 56 may be made of a material with a low thermal resistivity, such as copper, thermally conductive plastic or polymer, aluminum, or an aluminum alloy.

Figure 14:
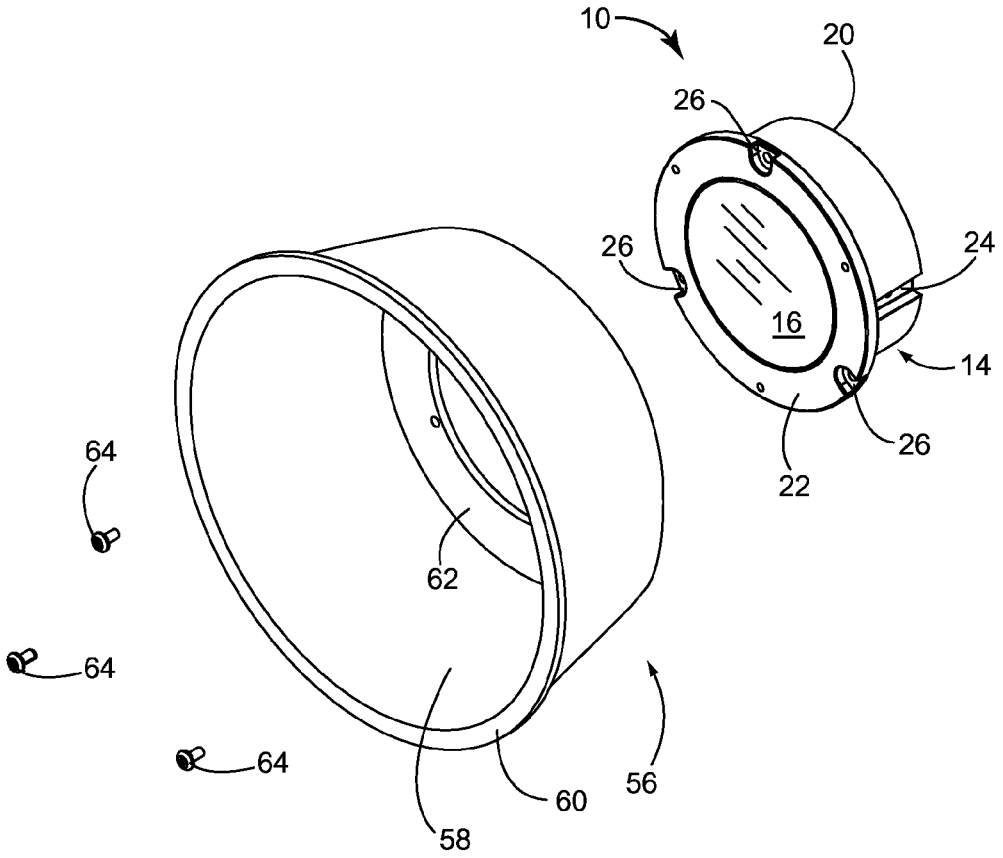
FIG. 14 is an exploded isometric view of the lighting fixture of FIG. 1 without the control module and with a trim.

FIG. 13 provides an exploded isometric view of the lighting fixture 10 including the trim 56. FIG. 14 provides an exploded isometric view of an alternative embodiment wherein the lighting fixture 10 in the assembly illustrated in FIGS. 11-13 is not provided with the control module 12. In such an embodiment, a remotely located control module may provide power to the lighting fixture 10.

Figure 15:
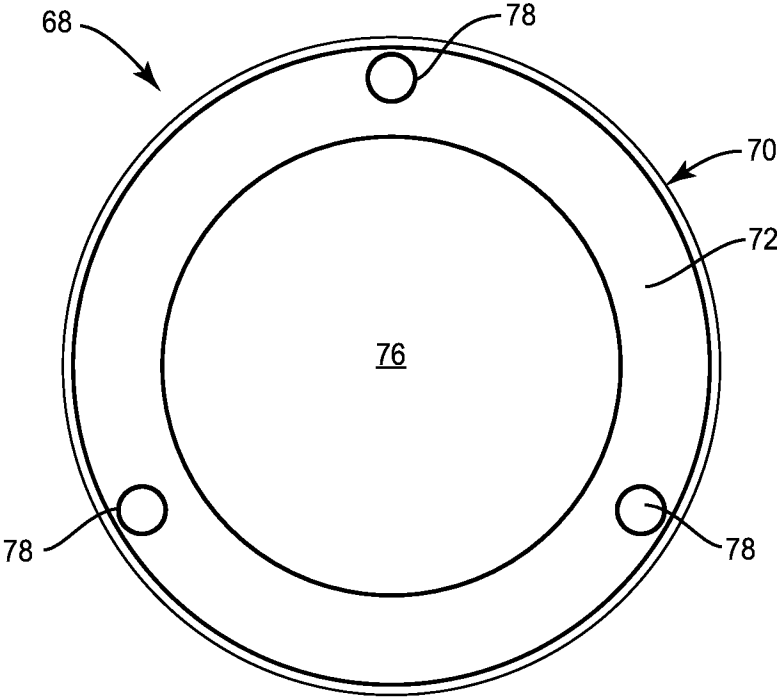
FIG. 15 is a front plan view of a concealer plate for use with the lighting Fixture of FIG. 14.

As discussed above, each one of the fasteners 64 may protrude from the front surface of the mounting portion 62 by the predetermined depth 66, such that each one of the fasteners 64 is exposed to the front of the trim 56. Accordingly, the fasteners 64 may be visible even after the lighting fixture 10 is installed. In some environments, customers may desire a uniform appearance when looking into the inside of the trim 56. Accordingly, FIGS. 15-19 show a concealer plate 68 configured to hide the fasteners 64 according to one embodiment of the present disclosure. FIG. 15 shows a front plan view of the concealer plate 68. The concealer plate includes a concealer plate body 70 having a first concealer plate surface 72, a second concealer plate surface 74 opposite the first concealer plate surface 72, an opening 76, and two or more magnets 78. Each one of the magnets 78 is recessed in the first concealer plate surface 72 of the concealer plate body 70, as discussed in further detail below. Notably, each one of the magnets 78 is recessed in the first concealer plate surface 72 of the concealer plate body 70 by a depth approximately equal to the predetermined depth 66 at which the fasteners 64 extend from the front surface of the mounting portion 62. Accordingly, when the first concealer plate surface 72 of the concealer plate 68 is placed in close proximity to the front surface of the mounting portion 62, each one of the magnets 78 magnetically engage with one of the fasteners 64, thereby holding the concealer plate 68 in place over the front surface of the mounting portion 62. Notably, each one of the magnets 78 may magnetically engage with one of the fasteners 64 without physically contacting the fasteners 64.

The concealer plate 68 may be substantially annular, such that the concealer plate body 70 of the concealer plate includes the opening 76 through which light from the lighting fixture 10 is delivered. The concealer plate 68 may further be contoured to the front surface of the mounting portion 62. For example, the concealer plate 68 may have a mitered edge that mirrors the interior curve of the sidewall 58 of the trim 56. The second concealer plate surface 74 may be substantially uniform, and further may match the interior of the trim 56 such that when the concealer plate 68 is in place, the interior of the trim 56 has a uniform appearance and the fasteners 64 are hidden from visibility. Using the magnets 78 to hold the concealer plate 68 in place allows for the concealer plate 68 to be installed with minimal effort and without tools. Further, the concealer plate 68 is easily retrofitted onto existing lighting fixtures 10, thereby foregoing the need for replacement of the lighting fixtures 10 in order to improve the aesthetic appeal thereof.

Figure 16:
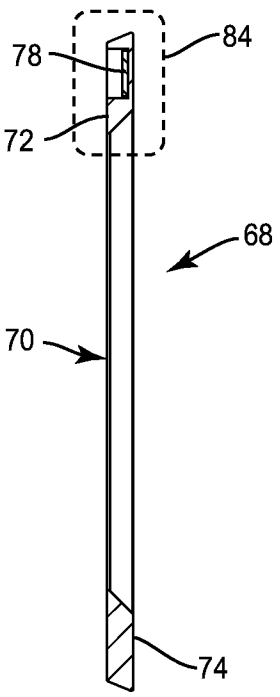
FIG. 16 is a side-plan view of the concealer plate of FIG. 15.
Figure 17B:
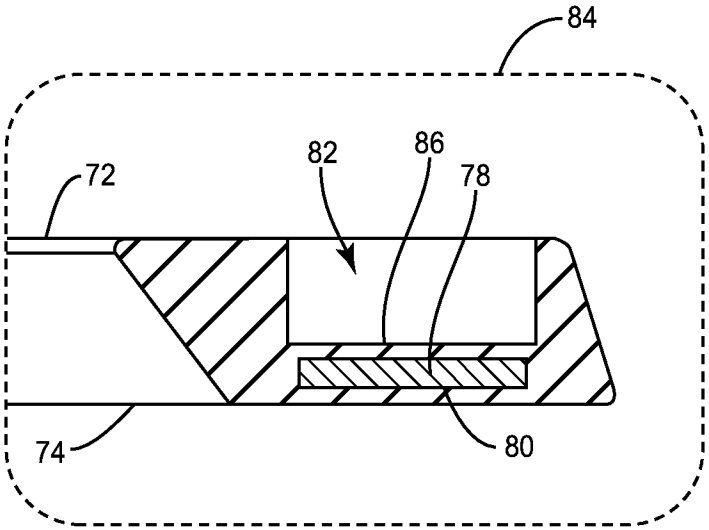
FIGS. 17A and 17B show details of the concealer plate shown in FIG. 15.
Figure 17A:
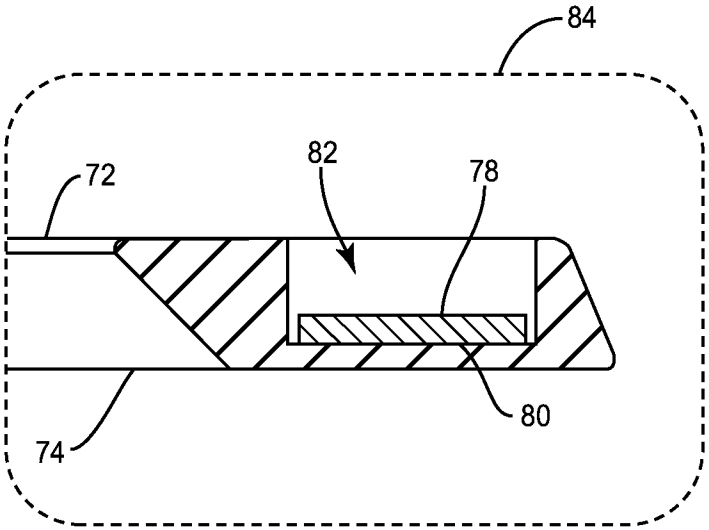

FIG. 16 shows a side plan view of the concealer plate 68. A dashed box 84 in FIG. 16 highlights one or more components of the concealer plate 68, the details of which are then shown in FIGS. 17A and 17B. As shown in FIG. 17A, each one of the magnets 78 may be mounted on a bottom surface 80 of a corresponding recess 82. FIG. 17B shows an alternative embodiment of the concealer plate 68 in which the magnets 78 are embedded in the concealer plate body 70. Specifically, each one of the magnets 78 may be embedded between the bottom surface 80 of a corresponding recess 82 and a recessed surface 86, such that each one of the magnets 78 is covered by the recessed surface 86. In such an embodiment, the depth of the recessed surface 86 may once again be approximately equal to the predetermined depth 66 at which the fasteners 64 extend from the front surface of the mounting portion 62 in order to accept the protruding portion of the fasteners 64.

Figure 18:
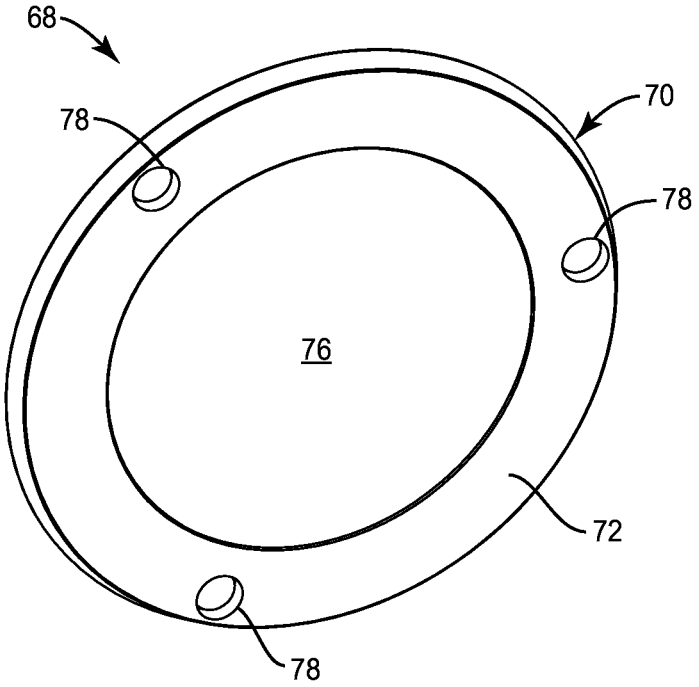
FIG. 18 is an isometric view of the concealer plate of FIG. 15.
Figure 19:
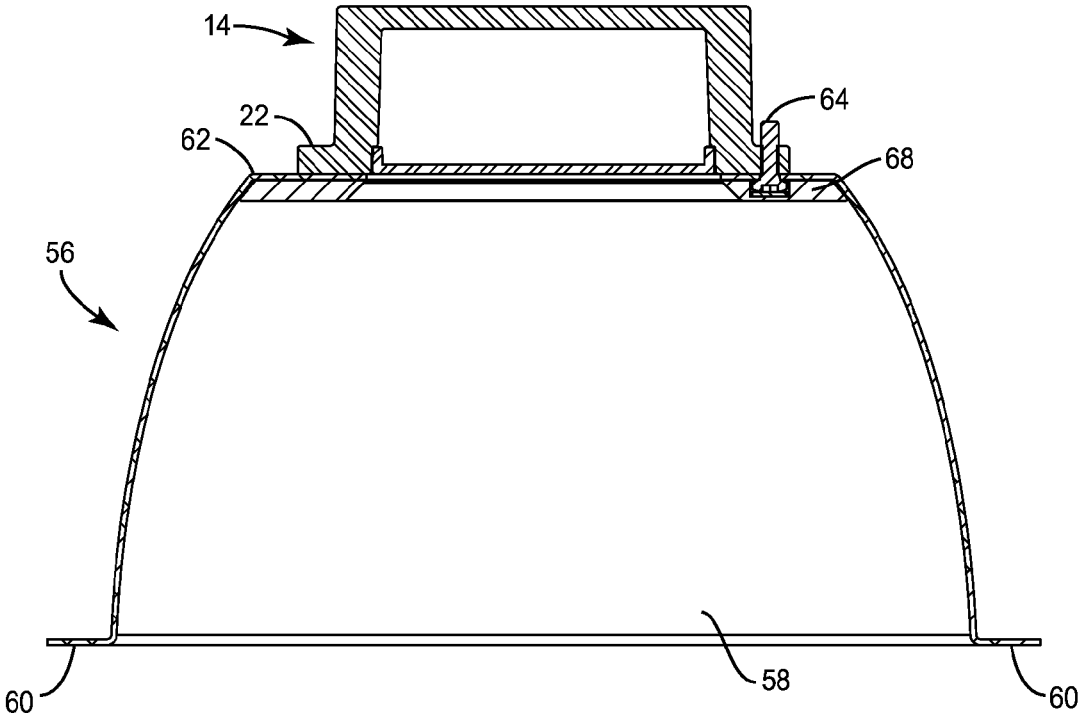
FIG. 19 is a side plan view of the assembly of FIG. 11 including the concealer plate of FIG. 15.

FIG. 18 shows an isometric view of the concealer plate 68, while FIG. 19 shows the lighting fixture 10 with the concealer plate 68 installed therein. The concealer plate 68 may be formed of any suitable material, for example, a plastic material. Further, the concealer plate 68 may be formed of a material that is resistant to ultraviolet (UV) light and/or other environmental conditions, such that the concealer plate 68 retains its appearance regardless of exposure to light generated by the light source 34 and/or ambient light from the environment. Finally, the magnets 78 may be selected to provide an appropriate level of magnetic engagement with each one of the fasteners 64 in order to securely attach the concealer plate 68 to a lighting fixture 10.

Although the magnets 78 shown in FIGS. 15-19 are recessed in the first concealer plate surface 72, the magnets 78 may be flush mounted with the first concealer plate surface 72 in other embodiments, or may be embedded in the first concealer plate surface 72 such that the resulting surface is substantially flush. Further, in other various embodiments the concealer plate 68 may be attached to the lighting fixture 10 by any suitable means, for example, using Velcro, adhesive, or the like.

Figure 20:
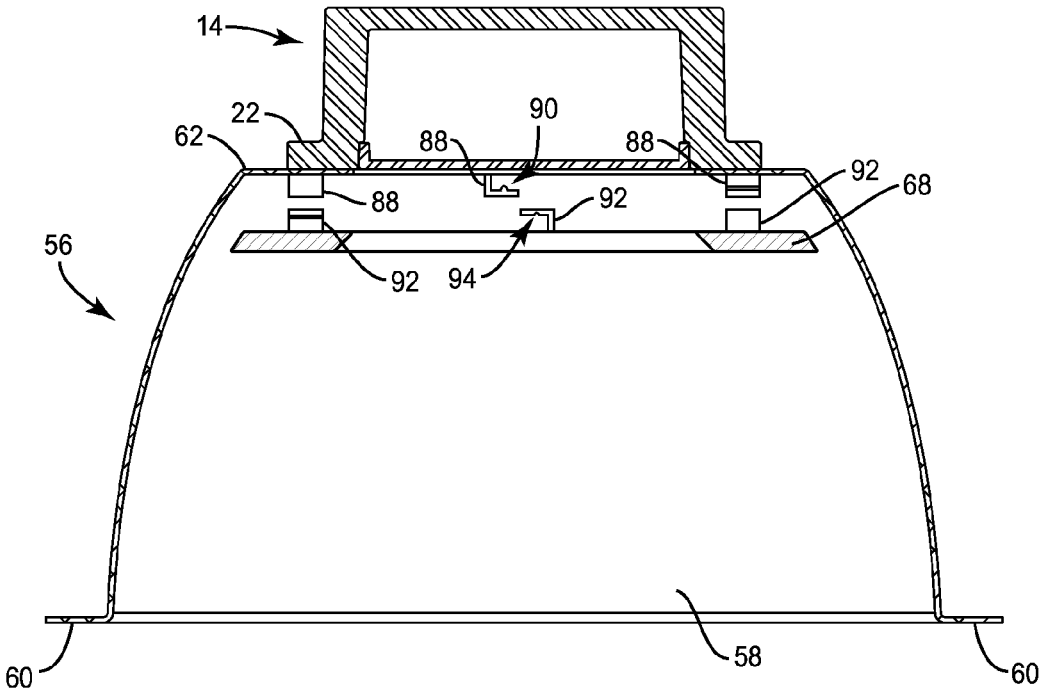
FIG. 20 is a side plan view of the assembly of FIG. 11 including a concealer plate according to one embodiment of the present disclosure.
Figure 21:
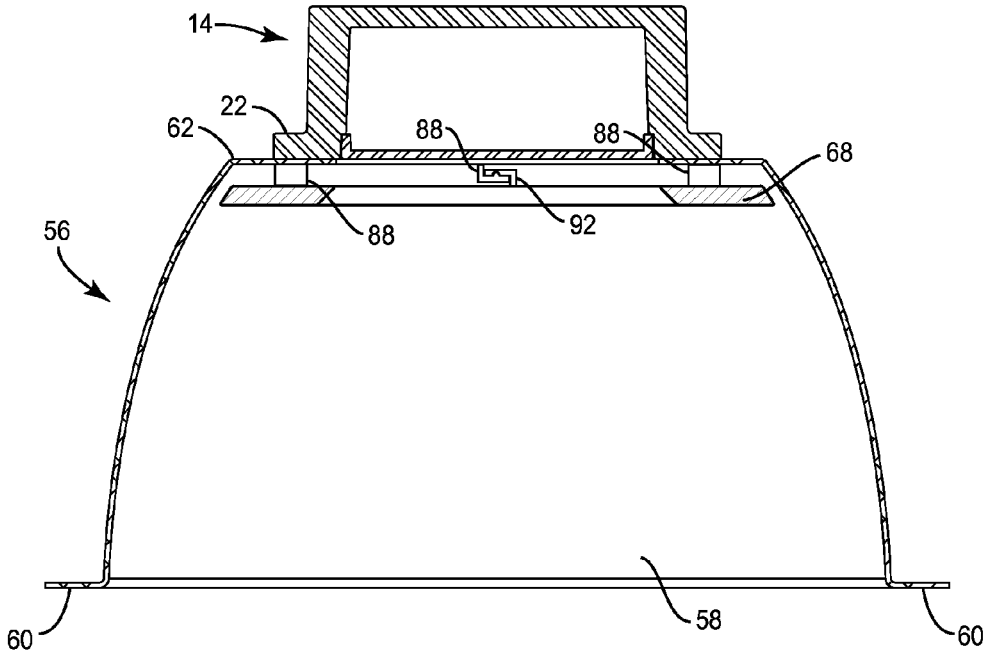
FIG. 21 is a side plan view of the assembly of FIG. 20 according to one embodiment of the present disclosure.

In one embodiment, the concealer plate 68 may be attached to the lighting fixture 10 via a mechanical attachment means. Accordingly, FIGS. 20 and 21 show an additional embodiment of the concealer plate 68 wherein the concealer plate is attached to the lighting fixture 10 via a rotating snap-lock mechanism. As shown in FIGS. 20 and 21, the front surface of the mounting portion 62 of the lighting fixture 10 may include a number of snap-lock fasteners 88, which are substantially "L" shaped, and further may include a protruding locking mechanism 90. Note that the front surface of the mounting portion 62 may include any number of snap-lock fasteners 88, however, three out of a total of four snap-lock fasteners 88 are shown in FIGS. 20 and 21 for purposes of illustration. The concealer plate 68 also includes a number of corresponding snap-lock fasteners 92, which further may include a recessed locking mechanism 94 corresponding to the protruding locking mechanism 82 of the snap-lock fasteners 88 on the front surface of the mounting portion 62 of the lighting fixture 10. To attach the concealer plate 68 to the lighting fixture 10, the corresponding snap-lock fasteners 92 of the concealer plate 68 may be held flush with the front surface of the mounting portion 62 of the lighting fixture 10, and the concealer plate 68 may be rotated such that the corresponding snap-lock fasteners 92 of the concealer plate 68 engage with the snap-lock fasteners 88 on the front surface of the mounting portion 62 of the lighting fixture 10. The protruding locking mechanism 90 of the snap lock fasteners 88 located on the front surface of the mounting portion 62 of the lighting fixture 10 may fill the recessed locking mechanism 94 of the corresponding snap-lock fasteners 92 on the concealer plate 68, thereby securing the connection between the concealer plate 68 and the lighting fixture 10. Accordingly, the concealer plate 68 may be held in place. In other embodiments, the concealer plate 68 may be attached to the lighting fixture 10 by any suitable mechanical means, for example, using a threaded connector, a twist-lock mechanism, or the like.

Those skilled in the art will recognize improvements and modifications to the embodiments of the present disclosure. All such improvements and modifications are considered within the scope of the concepts disclosed herein.

What is claimed is:

1. A concealer plate for a lighting fixture comprising:

a concealer plate body including a first concealer plate surface, a second concealer plate surface opposite the first concealer plate surface, a plurality of recesses each including a bottom surface and extending from the first concealer plate surface into the concealer plate body, and an opening extending through a central portion of the concealer plate body; and a plurality of magnets each embedded between the bottom surface of a respective one of the plurality of recesses and a recessed surface within the respective one of the plurality of recesses, wherein each of the plurality of magnets is configured to magnetically engage one of a plurality of fasteners used to attach a mounting portion of a trim to the lighting fixture such that the concealer plate hides the fasteners from view.

2. The concealer plate of claim 1 wherein a distance from a first magnetic surface of each one of the plurality of magnets opposite the bottom surface of one of the plurality of recesses to which the magnet is attached to the first concealer plate surface is approximately equal to a distance that each one of the plurality of fasteners protrudes from the mounting portion of the trim of the lighting fixture.

3. The concealer plate of claim 1 wherein the concealer plate is substantially annular.

4. The concealer plate of claim 3 wherein the plurality of magnets are substantially uniformly distributed about a radius of the concealer plate.

5. The concealer plate of claim 1 wherein light from the lighting fixture is delivered through the opening in the concealer plate.

6. The concealer plate of claim 1 wherein the concealer plate body and the opening are substantially circular.

7. The concealer plate of claim 6 wherein a thickness of the concealer plate body between the first concealer plate surface and the second concealer plate surface is between about 3 mm and 7 mm.

8. The concealer plate of claim 1 wherein the plurality of magnets are substantially uniformly distributed about a radius of the concealer plate.

9. The concealer plate of claim 1 wherein the concealer plate is plastic.

10. The concealer plate of claim 1 wherein the concealer plate is substantially contoured to a surface of the mounting portion.

11. The concealer plate of claim 10 wherein the second concealer plate surface is substantially uniform.

12. The concealer plate of claim 10 wherein the concealer plate is substantially annular.

13. The concealer plate of claim 12 wherein the plurality of magnets are substantially uniformly distributed about a radius of the concealer plate.

14. The concealer plate of claim 10 wherein the concealer plate is plastic.

15. A lighting fixture comprising:

a light source;

a trim including a sidewall extending between a mounting portion and a forward edge, wherein the light source is mounted to a first mounting surface of the mounting portion opposite the forward edge via a plurality of fasteners, such that light emitted from the light source is directed through an opening in the mounting portion and towards the forward edge; and a concealer plate comprising a concealer plate body including a first concealer plate surface, a second concealer plate surface opposite the first concealer plate surface, a plurality of recesses each including a bottom surface and extending from the first concealer plate surface into the concealer plate body, and an opening extending through a central portion of the concealer plate body, wherein when the concealer plate is attached to the lighting fixture:

each one of the plurality of fasteners used to attach the mounting portion of the trim to the lighting fixture fits into a corresponding one of the plurality of recesses;

each one of the plurality of fasteners is covered by the concealer plate and not visible; and the concealer plate is disposed completely within the trim.

16. The lighting fixture of claim 15 wherein the concealer plate further comprises a plurality of magnets each attached to the bottom surface of a respective one of the plurality of recesses and configured to magnetically engage one of the plurality of fasteners used to attach the mounting portion of the trim to the lighting fixture such that the concealer plate hides the fasteners from view.

17. The lighting fixture of claim 16 wherein a distance from a first magnetic surface of each one of the plurality of magnets opposite the bottom surface of one of the plurality of recesses to which the magnet is attached to the first concealer plate surface is approximately equal to a distance that each one of the plurality of fasteners protrude from the mounting portion of the trim of the lighting fixture.

* * * * *